United States Patent [19]

McAuliffe et al.

[11] Patent Number: 4,976,790

[45] Date of Patent: Dec. 11, 1990

[54] PROCESS FOR PREPARING LOW EARING ALUMINUM ALLOY STRIP

[75] Inventors: Donald C. McAuliffe, Golden; Ivan M. Marsh, Denver, both of Colo.

[73] Assignee: Golden Aluminum Company, Lakewood, Colo.

[21] Appl. No.: 315,408

[22] Filed: Feb. 24, 1989

[51] Int. Cl.[5] ..... C22F 1/04

[52] U.S. Cl. ..... 148/2; 148/11.5 A

[58] Field of Search ..... 148/2, 11.5 A

[56] References Cited

U.S. PATENT DOCUMENTS

| | | | |
|---|---|---|---|
| 3,379,583 | 4/1968 | Gruhl et al. | 148/11.5 A |
| 3,397,044 | 8/1968 | Bylund et al. | 420/550 |
| 3,560,269 | 2/1971 | Anderson et al. | 148/11.5 A |
| 3,571,910 | 3/1971 | Bylund | 29/527.7 |
| 3,709,281 | 1/1973 | Bolliger | 164/153 |
| 3,744,545 | 7/1973 | Gyongyos | 164/4 |
| 3,759,313 | 9/1973 | Gyongyos | 164/87 |
| 3,774,670 | 11/1973 | Gyongyos | 164/279 |
| 3,787,248 | 1/1974 | Setzer et al. | 148/11.5 A |
| 3,835,917 | 9/1974 | Gyongyos | 164/279 |
| 3,909,316 | 9/1975 | Hirata | 148/156 |
| 3,930,895 | 1/1976 | Moser et al. | 148/2 |
| 4,235,646 | 11/1980 | Neufeld et al. | 148/2 |
| 4,238,248 | 12/1980 | Gyongyos et al. | 148/2 |
| 4,269,632 | 5/1981 | Robertson et al. | 148/2 |
| 4,318,755 | 3/1982 | Jeffrey et al. | 148/11.5 A |

*Primary Examiner*—R. Dean

*Attorney, Agent, or Firm*—Sheridan, Ross & McIntosh

[57] ABSTRACT

This invention relates to a process for producing aluminum-containing strip stock which is suitable for drawing and ironing and has reduced earing. A continuously-cast, aluminum-containing strip is introduced into a hot-mill operation to provide a thickness reduction of at least 70 percent with the exit temperature of the strip being minimized. The strip is allowed to crystallize to form grain having an annealed texture. This strip is then subjected to cold rolling to reduce the thickness at least 30 percent. The cold-rolled strip is annealed at an intermediate annealing temperature. The annealed strip is then subjected to further cold rolling sufficient to optimize the balance between the 45° earing and yield strength.

16 Claims, 2 Drawing Sheets

PROCESS FOR PREPARING LOW EARING ALUMINUM ALLOY STRIP

FIELD OF THE INVENTION

This invention relates to a process for producing aluminum strip stock having improved formability and reduced earing.

BACKGROUND OF THE INVENTION

Aluminum alloys in the form of cold-rolled strip have been successfully processed into beverage cans by deep drawing and ironing. A number of processes are known for the production of aluminum strip for use in these beverage cans. Typically, aluminum is cast by known methods such as horizontal and vertical direct chill casting or strip casting for further treatment. One such known process is disclosed in U.S. Pat. No. 3,787,248 of Setzer et al. It is reported that this process produces strip which experiences a high degree of earing.

U.S. Pat. No. 4,238,248 of Gyongyos et al. (1980) discloses a multi-step process for producing an aluminum-containing strip which is reported to have improved formability and decreased earing. This patent is incorporated herein by reference in its entirety.

A typical measurement for earing is the 45° earing or 45° rolling texture. This value is determined by measuring the height of ears which stick up in a cup minus the height of valleys between the ears. This difference is divided by the height of the valleys times 100 to convert to a percentage. The 45° earing is measured at 45° to the longitudinal axis of the strip.

While the process disclosed in U.S. Pat. No. 4,238,248 is useful in producing material having reduced earing, it has now been found that earing in cast strip can be reduced while maintaining yield strength by using the process of the instant invention.

SUMMARY OF THE INVENTION

The instant invention involves a process for producing aluminum-containing strip stock which is suitable for drawing and ironing having reduced earing. In the process, an aluminum-containing melt is continuously cast in strip form in a caster. The strip having a first thickness is removed from the caster and introduced into a hot-mill operation at a strip temperature of between about 880° F. and about 1,000° F. The strip is hot rolled to reduce the thickness of the strip by at least about 70 percent and provide a hot-rolled strip having a second thickness. The exit temperature of the strip from the hot-roll operation is no greater than about 650° F. Thee strip is then cold rolled to provide a cold-rolled strip having a third thickness. This cold-rolled strip is annealed at an intermediate annealing temperature to provide an annealed strip. The annealed strip is then subjected to further cold rolling which is sufficient to optimize the balance between the 45° earing and yield strength and provide a product strip having a fourth thickness.

In a further embodiment, the instant invention involves processing a 5017 alloy by introducing a cast strip of the alloy into a hot roll at a temperature between about 900° F. and 975° F. This strip is hot rolled to reduce the thickness by at least about 70 percent with the strip exiting the hot rolls at a temperature below about 630° F. The strip is cold rolled to reduce the thickness by at least 35 percent with the cold-rolled strip being coiled. The coiled strip is annealed at an intermediate annealing temperature of between 695° F. and 705° F. The annealed strip is then cold worked between 40 percent and 50 percent.

In another embodiment, the instant invention involves a method for producing an aluminum-containing strip stock suitable for making can bodies and having a reduced earing. Aluminum-containing melt is continuously cast in strip form in a caster and introduced into a hot-roll operation at a strip temperature of between about 880° F. and 975° F. The strip is hot rolled to reduce the thickness by at least about 80 percent with the strip exiting the hot-roll operation at a strip temperature no greater than 630° F. The strip is coiled and allowed to crystallize to form grain having an annealed texture. The resulting strip is cold rolled to reduce the thickness by at least about 35 percent with the resulting strip being coiled. The coil is subjected to an intermediate annealing operation with the annealed strip being cold rolled at a cold-work percentage sufficient to optimize the balance between the 45° earing and the yield strength.

DETAILED DESCRIPTION OF THE INVENTION

Figure 1:
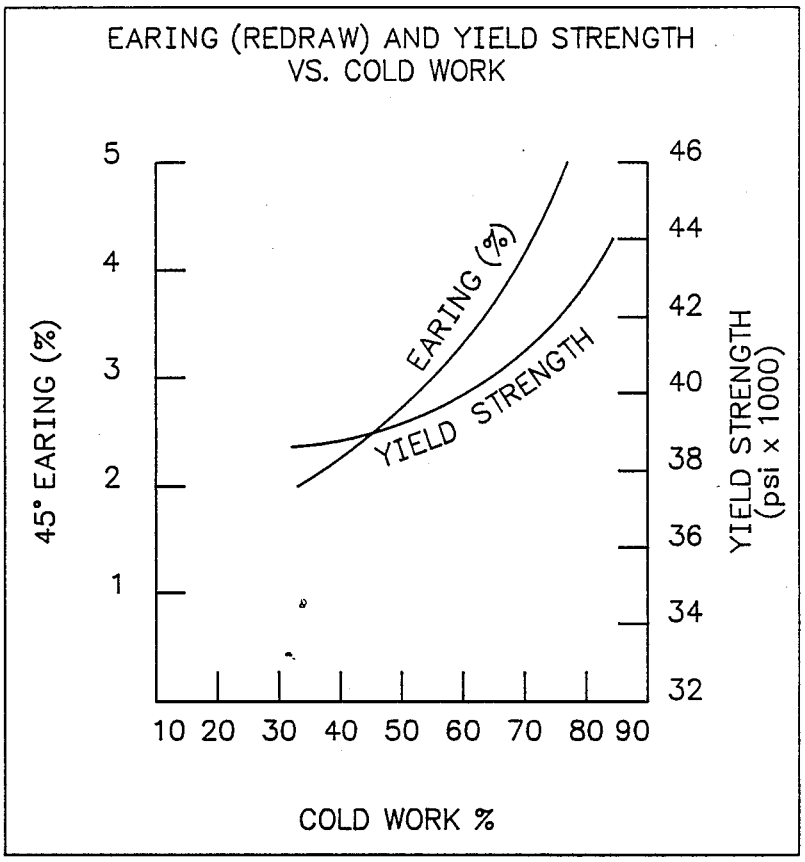
FIG. 1 is a graph showing a comparison of 45° earing and yield strength (in pounds per square inch × 1000) versus cold work percentage.

The present invention comprises a process for producing aluminum sheet which has improved yield strength and reduced earing. The method involves a combination of particular hot-milling and cold-rolling process conditions. The strip stock which is produced is especially suitable for use in the production of deep drawn and ironed articles such as beverage cans or the like.

A strip caster which is particularly useful in the present invention is described in detail in U.S. Pat. Nos. 3,709,281, 3,744,545, 3,759,313, 3,774,670, and U.S. Pat. No. 3,835,917, all of which are incorporated herein by reference in their entirety, as well as U.S. Pat. No. 4,238,248.

To minimize body maker tear-offs, pin holes and split flanges in the finished can, it is important to assure internal metal quality. This can be accomplished by passing the molten metal through an intermediate degassing unit and final rigid media filter to provide minimal gaseous and solid metallic oxide inclusion content in the melt. It is preferred that the gas content lie essentially zero as measured by a gas analyzer and there be a maximum inclusion of 0.03 square millimeters per kilogram of sample as determined metallographically from a specimen taken from a molten metal filtration unit just prior to metal flow into the caster.

In the caster preferred for the instant process, two sets of chilling blocks are employed and rotate in opposite directions to form a casting cavity into which the aluminum alloy is brought through a thermally insulated nozzle system. This apparatus is described in detail in U.S. Pat. No. 4,238,248 incorporated hereinabove. The liquid metal, upon contact with the chilling blocks, is cooled and solidified. The strip of metal travels during this cooling and solidifying phase along with the chilling blocks until the strip exits the casting cavity where the chilling blocks lift off the cast strip and travel to a cooler where the chilling blocks are cooled.

In this casting, there are two important temperature ranges in cooling the aluminum alloy from the liquid state. The first temperature range is the temperature between the lididus and the sclidus of the aluminum alloy. The second temperature range is between the solidus and a temperature 100° C. below the solidus. The rate of cooling as the cast strip passes through the casting cavity of the strip casting machine is controlled by various process and product parameters. These parameters include the composition of the material being cast, the strip gauge, chill block material, length of casting cavity, casting speed and efficiency of the chill block cooling system.

It has been found that strip produced using the caster described in U.S. Pat. No. 4,238,248 has both a minimal 8 to 12 micron thick surface segregation layer and a structure containing a nominal of 60 percent $SiFeMnAl_6$ transferred alpha phase. During the solidification process, beta phase is transformed into at least about 60 percent alpha phase. This structure carries through into the finished strip.

It is preferred that the cast strip be as thin as possible. This minimizes the subsequent working of the strip. Normally, a limiting factor in obtaining minimum strip thickness is being able to uniformly pass metal through the distributor tip into the caster. Presently, the strip is cast at a thickness between about 0.6 and about 0.8 inches. However, it is anticipated that thinner strip may be cast in the future.

The cast strip is passed to a hot-mill which consists of a series of hot-rolling steps. The strip normally exits the caster in the temperature range of about 850° F. to about 1,100° F. and preferably enters the first hot roll at a temperature in the range of about 880° F. to about 1,000° F., and more preferably in the range of about 900° F. to about 975° F. It has been found unexpectedly that strip product having improved properties can be obtained if, in addition to the other process steps indicated herein, the temperature of the strip exiting the hot mill is minimized. To obtain the desired product properties, the exit temperature from the hot mill should be no more than about 650° F. As indicated hereinabove, this temperature should be minimized. Since ordinarily this strip exiting the hot-mill operation is coiled, the practical lower limit is the coiling temperature. As used herein, the term "coiling temperature" is used to mean the lowest temperature at which a strip can be coiled with the particular coiling equipment being used. The minimum useful temperature at which the strip can exit the hot mill is the coiling temperature. Commonly, the lower coiling temperature limit is in the range of about 500° F. to about 560° F. Preferably, the temperature at which the strip is coiled (also referred to herein as the "hot coil temperature") is less than about 640° F. and more preferably less than about 630° F.

It has been found that to obtain the desired properties, the gauge or thickness of the strip should be minimized in the hot-mill operation, i.e., the reduction in thickness should be maximized. Preferably, the thickness of the strip is reduced by at least about 70 percent, more preferably at least 75 percent and most preferably at least about 80 percent in the hot-mill operation. The gauge or thickness of the strip is normally limited by the power available with the particular roll equipment being used. Normally, the thickness of the strip from the hot rolls is in the range of about 0.04 to about 0.08 inches. This thickness, of course, depends upon the thickness of the cast strip. The hot-roll strip gauges provided hereinabove are based upon a cast strip having the thickness of between about 0.6 and 0.8 inches. A thinner cast strip could, of course, enable the formation of a thinner strip from the hot rolling process.

The speed of the strip through the hot-mill operation is adjusted according to the necessary exit temperature for the strip. The speed of the strip is also dependent upon the particular rolling equipment being used. A typical exit speed for strip having a gauge of about 0.08 inches is in the range of about 150 to 200 feet per minute.

The strip from the hot rolls is then preferably coiled. The coiled strip can be allowed to cool to ambient temperature before further processing such as annealing. To obtain the desired metallurgy for the alloy, it is important to recrystallize the grain from hot-roll texture to annealed texture. If the coil is of sufficient mass, this crystallization can be accomplished by simply allowing the coil to cool to ambient temperature. However, if the coil is of a smaller mass, it can be necessary to anneal the coil in order to obtain the desired crystallization. If an annealing step is used, it is preferable that the hot coil be subjected to the annealing step before cooling in order to minimize energy requirements. The annealing is normally accomplished at a temperature in a range of about 600° F. to about 800° F. and more preferably in the range of about 600° F. to about 700° F. The coil is maintained at the maximum annealing or "soak" temperature for about 2 to about 6 hours. Normally, the total time involved in heating the coil to the annealing temperature, soaking at the annealing temperature and cooling the coil to ambient temperature is about 8 to about 12 hours.

The coil from the annealing step is then subjected to a cold-rolling operation. In this operation, the strip is cold rolled to reduce the thickness of the strip. Preferably, the thickness of the strip is reduced by at least about 30 percent, more preferably at least about 35 percent, and most preferably at least about 40 percent in this cold-roll step. This strip is then coiled to form a cold-rolled coil. This coil is then subjected to an intermediate annealing step followed by additional cold rolling. The thickness of the strip during this annealing operation is referred to herein as the cold-coil gauge or intermediate-annealing gauge. The final cold working step is a significant factor in controlling the earing of the product. The amount of reduction in thickness needed in the final cold-roll step, i.e., the final cold-work percentage, determines the amount of reduction in thickness required in the first cold-rolling step.

The preferred final cold-work percentage is that point at which the optimum balance between the yield strength (measured in pounds per square inch) and earing are obtained. That point is depicted in FIG. 1 as the cold-work percentage at which the yield strength curve crosses the 45° earing curve. This point can be readily determined for a particular alloy composition by plotting each of the yield strength and earing values against the cold-work percentage. Once this preferred cold-work percentage is determined for the final cold-rolling strip, the gauge of the strip during the intermediate annealing stage and, consequently, the cold-working percentage for the initial cold-roll step can be determined.

The final cold-work percentage required to minimize earing is dependent upon the composition of the particular alloy. For example, for alloy 5017, the preferred final cold-work percentage is approximately 40 to 50 percent, most preferably about 45 percent. The 5017 alloy has a composition with the following components in the indicated weight percent ranges: manganeses—0.6 to 0.8; silicon—0.15 to 0.4; iron—0.3 to 0.7; copper—0.18 to 0.28; magnesium—1.3 to 2.2; trace materials—less than about 0.25 with the balance being aluminum. It is expected that aluminum alloys with higher magnesium content have higher cold-work percentages.

In a preferred embodiment of the instant process, alloy 5017, which has been subjected to hot-mill and annealing to provide a strip having a thickness of about 0.08 inches, is subjected to cold rolling to provide a strip having a thickness of about 0.025 inches. This strip is preferably coiled and then subjected to an intermediate annealing step at a temperature between about 695° F. and about 705° F. The annealed strip is cold rolled to a thickness of 0.0138 inches corresponding to a final cold-work percentage of 45 percent.

The intermediate annealing is conducted to provide a soak at the annealing temperature of at least about 2.5 hours. Preferably, the soak time is about 3 and about 3.5 hours. Normally, a total of about 9 to about 12 hours is required to heat the coil to the annealing temperature, soak at the annealing temperature and cool the coil down to ambient temperature.

The following examples are intended by way of illustration and not by way of limitation.

EXAMPLES

A Taguchi multivariant test was designed to evaluate the effect of certain fabricating variables on earing as determined in a redraw cup. A series of 10 coils were prepared using the same casting conditions (within the ranges described hereinabove) and the same alloy (alloy 5017), as closely as these could be controlled. The effects of (a) magnesium concentration in the alloy (b) hot mill exit gauge (c) hot mill anneal temperature (°F.) and (d) intermediate anneal temperature (°F.) were measured. The results are given in Table 1. It can be seen that both the hot mill gauge and intermediate anneal temperature significantly affect the earing of the product. The amount of magnesium and hot-mill anneal temperature have little effect.

Figure 2:
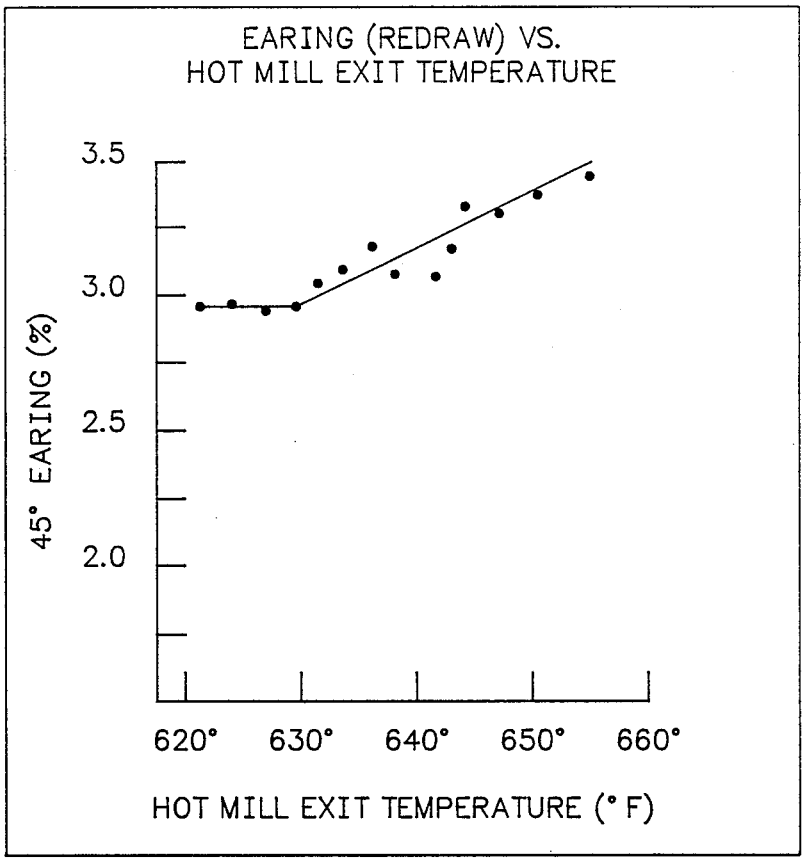
FIG. 2 is a graph showing the percent of 45° earing versus hot mill exit temperature.

Additional tests were conducted to determine if the hot-mill exit temperature of the strip had any effect on earing. The results of runs made using constant casting conditions with a single alloy composition (alloy 5017) are given in FIG. 2. The hot-mill exit temperature was changed from 620° F. to over 650° F. The 45° earing was determined. These results show that the hot-mill exit temperature should be minimized to minimize earing.

The cumulative effect of controlling the variables within the range of the instant invention is provided in Table 2. The variables controlled are listed. The value for earing given for a variable both "Before Control" and "After Control" includes the control of the preceding variable(s), i.e., the value given for "45 percent final cold work" includes control of hot-mill exit gauge, 700° F. intermediate anneal, and hot-mill exit temperature. For materials made "Before Control", the hot-mill exit temperature ranged from about 650° F. to 700° F., both the hot mill and intermediate anneal temperatures were 795° F., and the final cold work was 54 percent.

TABLE 1

TAGUCHI MULTIVARIANT TEST
PRIMARY EFFECTS ON EARING (REDRAW)

| Variable | Level | | | Contribution % |
|---|---|---|---|---|
| Magnesium (wt %) | 1.6 | 1.85 | 2.10 | 2.11 |
| Hot Mill Exit Gauge | .080* | .100 | .115 | 39.02 |
| Hot Mill Anneal Temperature (°F.) | 700 | 750 | 800 | 6.69 |
| Intermediate Anneal Temperature (°F.) | 700* | 750 | 800 | 49.89 |
| Error | | | | 2.29 |

*Value which produced the lowest earing

TABLE 2

EFFECT OF CONTROLLED VARIABLES
ON EARING (REDRAW)

| Variables | Earing Before Control | Earing After Control |
|---|---|---|
| .080 inch Hot Mill Exit Gauge and 700° F. Intermediate Anneal Temperature | 3.6% to 4.0% | 3.1% 3.4% |
| Maximum 630° Hot Mill Exit Temperature | 3.1% to 3.4% | 2.8% 3.1% |
| 45% Final Cold Work | 2.6% to 3.1% | 2.2% 2.7% |

While various embodiments of the present invention have been described in detail, it is apparent that modifications and adaptations of those embodiments will occur to those skilled in the art. However, it is to be expressly understood that such modifications and adaptations are within the spirit and scope of the present invention as set forth in the following claims.

What is claimed is:

1. A method for producing aluminum alloy strip stock suitable for drawing and ironing and having reduced earing in which aluminum alloy melt is continuously cast in strip form in a caster, the improvement comprising:

(a) introducing said aluminum alloy strip from said caster said strip having a first thickness into hot rolls at a strip temperature of between about 880° F. and 1,000° F;

(b) hot rolling said strip to reduce the thickness of said strip by at least about 70% and provide a hot-rolled strip having a second thickness;

(c) recovering said hot-rolled strip from said hot rolls at a temperature no greater than about 650° F.;

(d) cold rolling said hot-rolled strip recovered in step (c) to provide a cold-rolled strip having a third thickness;

(e) annealing said cold-rolled strip at an intermediate annealing temperature to provide an annealed strip; and (f) subjecting said annealed strip to further cold rolling sufficient to optimize the balance between the 45° earing and yield strength and provide a strip having a fourth thickness.

2. The method of claim 1 wherein said aluminum alloy strip is introduced into said hot rolls at a temperature of between about 900° F. and 975° F.

3. The method of claim 1 wherein said hot rolling reduces said first thickness of said strip by at least about 75%.

4. The method of claim 1 wherein said strip from said hot rolls is coiled and said coil is annealed at a temperature of between about 600° F. and 800° F. for a time of at least about 2 hours.

5. The method of claim 1 wherein said third thickness is no greater than about 65% of said second thickness.

6. The method of claim 1 wherein said fourth thickness is less than 60% of said third thickness.

7. The method of claim 1 wherein said aluminum alloy strip has a composition comprising about 0.6 to 0.8 weight % manganese, 1.3 to 2.2 weight % magnesium, 0.15 to 0.4 weight % silicon, 0.3 to 0.7 weight % iron, 0.18 to 0.28 weight % copper, less than about 0.25 weight trace elements and the balance aluminum.

8. The method of claim 1 wherein the temperature of said hot-rolled strip as it is removed from said hot rolls is between about 600° F. and 630° F.

9. The method of claim 7 wherein the cold-rolled strip is annealed at a temperature of between about 695° F. and 705° F.

10. The method of claim 1 wherein said hot-rolled strip is allowed to crystallize to form grain having an annealed texture.

11. The method of claim 1 wherein the temperature of said strip entering said hot rolls is between about 900° F. and 975° F., said strip is hot rolled to reduce the thickness by at least about 80%, the temperature of the hot-rolled strip from said hot rolls is less than about 630° F., said hot-rolled strip is allowed to crystallize to form grain having an annealed texture, said cold rolling provides a third thickness which is less than about 60% of said second thickness, said cold-rolled strip is annealed at an intermediate annealing temperature of between about 695° F. and 705° F., and said intermediate annealed strip is cold worked between about 40% and about 50%.

12. The method of claim 11 wherein said aluminum alloy strip has a composition comprising about 0.6 to 0.8 height % manganese, 1.3 to 2.2 weight % magnesium, 0.15 to 0.4 weight % silicon, 0.3 to 0.7 weight % iron, 0.18 to 0.28 weight % copper, less than about 0.25 weight trace elements and the balance aluminum.

13. A method for producing an aluminum alloy strip stock suitable for making can bodies and having reduced earing in which aluminum alloy melt is continuously cast in strip form in a caster, said method comprising:

(a) introducing said strip from said caster into a hot mill at a strip temperature of between about 880° F. and about 975° F.;

(b) hot rolling said strip to reduce the thickness of said strip by at least about 70% and produce a hot-rolled strip;

(c) removing said hot-rolled strip from said hot mill at a temperature less than about 640° F., annealing said hot-rolled strip at a temperature of between about 600° F. and about 800° F. for a period of at least about 2 hours to provide an annealed strip;

(d) cold rolling said annealed strip to provide a cold-rolled strip having a thickness less than about 65% of said annealed strip, annealing said cold-rolled strip at an intermediate annealing temperature of between about 690° F. and 710° F.; and (e) subjecting said intermediate annealed strip to further cold rolling at a cold-work percentage sufficient to optimize the balance between the 45° earing and the yield strength of the product strip produced.

14. The method of claim 11 wherein said strip recovered from said hot rolls is coiled and said coil is annealed at a temperature of between 600° F. and 700° F. for a period of at least about 2 hours and wherein said cold-rolled strip is coiled before annealing at an intermediate annealing temperature.

15. The method of claim 13 wherein said hot-rolled strip removed from said hot mill is coiled and said coil is allowed to cool to ambient temperature to crystallize the grain to an annealed texture.

16. The method of claim 15 wherein said cold-rolled strip is coiled before said annealing.

* * * * *